US006477819B1

(12) United States Patent
Focke et al.

(10) Patent No.: US 6,477,819 B1
(45) Date of Patent: Nov. 12, 2002

(54) METHOD AND APPARATUS FOR PRODUCING (FOLDING) CARTONS

(75) Inventors: Heinz Focke, Verden (DE); Wolfgang Heinzig, Apen (DE)

(73) Assignee: Focke & Co. (GmbH & Co.), Verden (DE)

( * ) Notice: Subject to any disclaimer, the term of this patent is extended or adjusted under 35 U.S.C. 154(b) by 46 days.

(21) Appl. No.: 09/610,928

(22) Filed: Jul. 6, 2000

(30) Foreign Application Priority Data

Jul. 9, 1999 (DE) ..... 199 31 946

(51) Int. Cl.[7] ..... B65B 57/00

(52) U.S. Cl. ..... 53/53; 53/75; 53/282; 53/54; 493/12

(58) Field of Search ..... 53/496, 53, 75, 53/572, 237, 282, 284, 54, 498; 493/7, 12

(56) References Cited

U.S. PATENT DOCUMENTS 3,954,165 A * 5/1976 Snyder
4,349,998 A * 9/1982 Covert ..... 53/53
4,934,129 A * 6/1990 Hoffman et al. ..... 53/496
4,984,409 A * 1/1991 Focke ..... 53/53
6,158,193 A * 12/2000 Focke et al. ..... 53/53

FOREIGN PATENT DOCUMENTS

DE 38 16 856 A1 11/1989

* cited by examiner

*Primary Examiner*—Eugene Kim
*Assistant Examiner*—Sameh Tawfik
(74) *Attorney, Agent, or Firm*—Todd Deveau; Ryan A. Schneider; Troutman Sanders LLP

(57) ABSTRACT

Apparatus for producing (folding) cartons or for closing the same by applying adhesive strips (13) to folding flaps (11) during an upward movement of the cartons (10) by a closing conveyor (21), the closed cartons (10) being transferred in the region of an upper transfer station (33) to a removal conveyor (22) and defective cartons (43), previously detected by monitoring, being able to be conveyed past the removal conveyor (22) into the region of a transfer station for such defective cartons (43).

9 Claims, 4 Drawing Sheets

43
49
50
47
48
29
42
41
27
45
40
24
35
32
23
34
51
31
28
26
13
10
26

METHOD AND APPARATUS FOR PRODUCING (FOLDING) CARTONS

This is a priority application based upon German patent application 199 31 946.4, filed Jul. 9, 1999.

FIELD OF THE INVENTION

The invention relates to a method for producing (folding) cartons which, after filing, are closed by folding flaps, of which outer folding flaps are held in the closed position by adhesive bonding, in particular by an externally applied adhesive tape. Furthermore, the invention relates to an apparatus for carrying out the method.

The capacity of carton packers has to meet increasingly high requirements. On the other hand, such packing machines are to remain limited in their dimensions.

BACKGROUND OF THE INVENTION

The invention is therefore based on the object of improving a carton packer to the extent that defective packs which are detected are reliably separated out and nevertheless the dimensions of the packing machine remain limited.

To achieve this object, the method according to the invention is characterized by the following features:

a) for closing, the cartons are transported along a conveying section, in particular a vertical conveying section—the closing section, b) the cartons are examined with regard to correct formation, in particular with regard to the correct formation of the closure, c) correctly formed cartons are transferred at the (upper) end of the closing section in the region of a transfer station to a removal conveying section, in particular a horizontally directed removal conveying section, d) any defectively formed cartons—defective cartons—are conveyed past the transfer station into the region of a removal station for defective cartons.

SUMMARY OF THE INVENTION

The method according to the invention therefore provides that the defective cartons are transported past the removal conveyor for the correctly formed cartons and are removed in the region of a subsequent station.

The carton packer according to the invention is designed in such a way that the cartons are fed by a carton conveyor—closing conveyor—in a vertical direction to a removal conveyor. Defective cartons are moved by the same carton conveyor past the transfer station or the removal conveyor into a removal station for the defective packs. In the case of a vertical carton conveyor or closing conveyor, this station is formed according to the invention in the region of a downwardly proceeding conveying section, at a distance from a lower transfer station for the cartons.

A further special feature of the invention is that the carton conveyor has special receptacles for at least one carton each. These receptacles are of an angular form in cross section and are mounted on the carton conveyor in such a way that they can tip. A special feature is that the cartons are picked up or transferred to other conveying members by an automatically proceeding tipping movement brought about by relative movement.

Further special features of the invention are explained in more detail below on the basis of an exemplary embodiment of the apparatus represented in the drawings, in which:

DETAILED DESCRIPTION OF THE DRAWINGS

Figure 1:
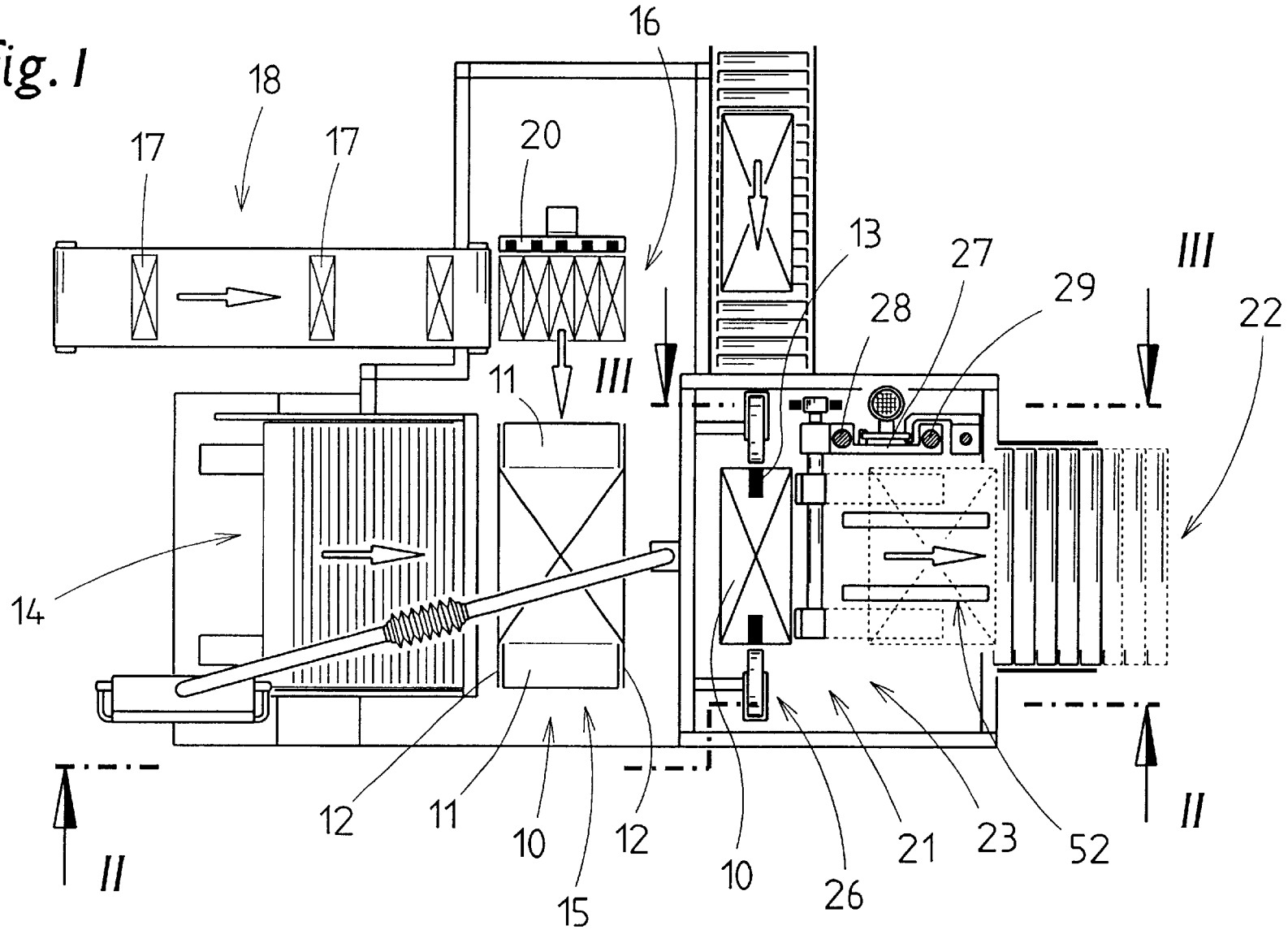
FIG. 1 shows a carton packer in schematic plan view.

The apparatus represented in the drawings is a carton packer for producing, filling and transporting away cartons 10 of corrugated cardboard or similar packaging material. The cartons 10 are constructed in such a way that, in the region of two mutually opposite sides, in particular in the region of a bottom wall and an end wall, folding flaps 11, 12 are formed. These are folded over for the closing of the carton 10, so that outer folding flaps 11 rest on inner folding flaps 12. The outer folding flaps 11 are joined to one another by adhesive bonding, to be specific by an applied adhesive strip 13.

The cartons 10 are removed from a magazine 14 in a flat, collapsed state. In the region of a filling station 15, the carton 10 is erected. Open sides with the folding flaps 11, 12 are directed sideways. The content of the carton is pushed into the carton 10 via one open side.

In the present exemplary embodiment, the carton 10 receives a group 16 of individual packs 17. The individual packs 17 are supplied by a feed conveyor 18. In the region of a grouping station, the individual packs 17 are collected in layers on a stacking table 19, forming the multilayered group 16. The group 16 is pushed by a pusher 20 into the carton 10 which is open at the side.

Then, the folding flaps 11, 12 are folded into the closed position. The then closed carton 10 is transferred to a carton conveyor or a closing conveyor 21. This is designed in a special way.

The closed cartons 10 are moved upwards by the closing conveyor 21 and, at the upper end of the conveying section, are transferred in a transfer station 33 to a horizontal removal conveyor 22. This is designed here as a roller conveyor.

The closing conveyor 21 is equipped with a receptacle 23 which can move up and down and is for at least one carton 10. Alternatively, there may also be a plurality of receptacles 23, in particular two. The receptacle 23 is of an angular form in cross section, with two carrying legs 24, 25 arranged at right angles in relation to each other. The carton 10 is transferred to the closing conveyor 21 or the receptacle 23 in its lower end position by transverse movement, to be precise in the present case by a tipping movement. The carton 10 thereby comes to lie with a narrower side surface on the shorter or narrower carrying leg 24 of the receptacle 23. The other, upright carrying leg 25 serves as an abutment for an upright side wall of the carton. The folding flaps 11 are in this case directed sideways.

The carton 10 is then moved upwards by the closing conveyor 21, to be precise through a closing unit 26. This brings about a permanent closure of the folding flaps 11 by applying the adhesive strip 13 for joining the outer folding flaps 11 to one another. During the upward movement of the carton 10, the closing unit 26 applies the adhesive strip 13 on both sides of the same as a result of the relative movement.

After reaching an upper end position, the carton 10 is transferred to the horizontal removal conveyor 22, to be precise again by a tipping movement, so that the carton 10 rests with a larger side surface on the removal conveyor 22.

The receptacle 23 for the carton 10 is arranged on the carton conveyor or closing conveyor 21 in such a way that it can tip.

Figure 2:
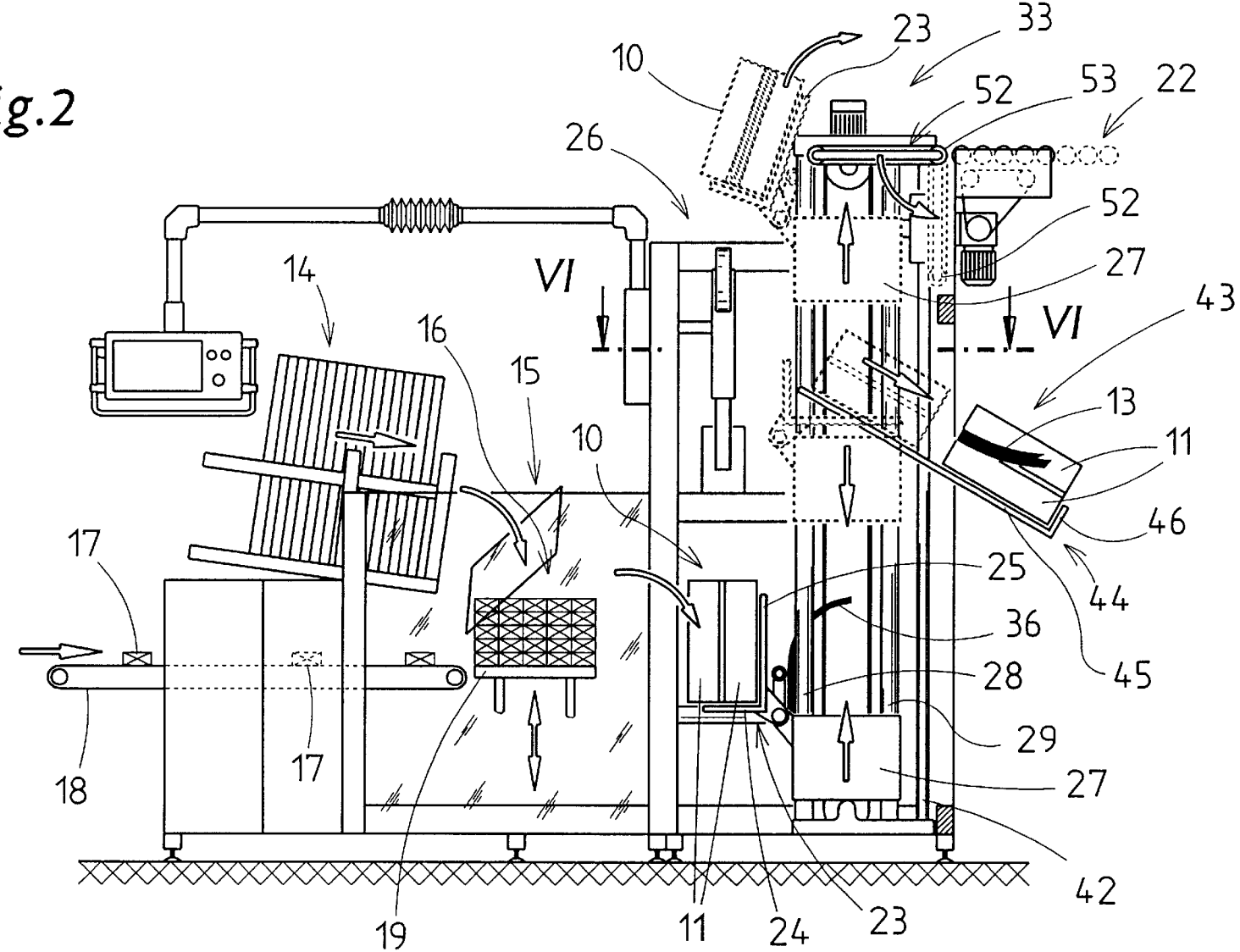
FIG. 2 shows the carton packer according to FIG. 1 in side view and in a vertical sectional plane II—II of FIG. 1.
Figure 3:
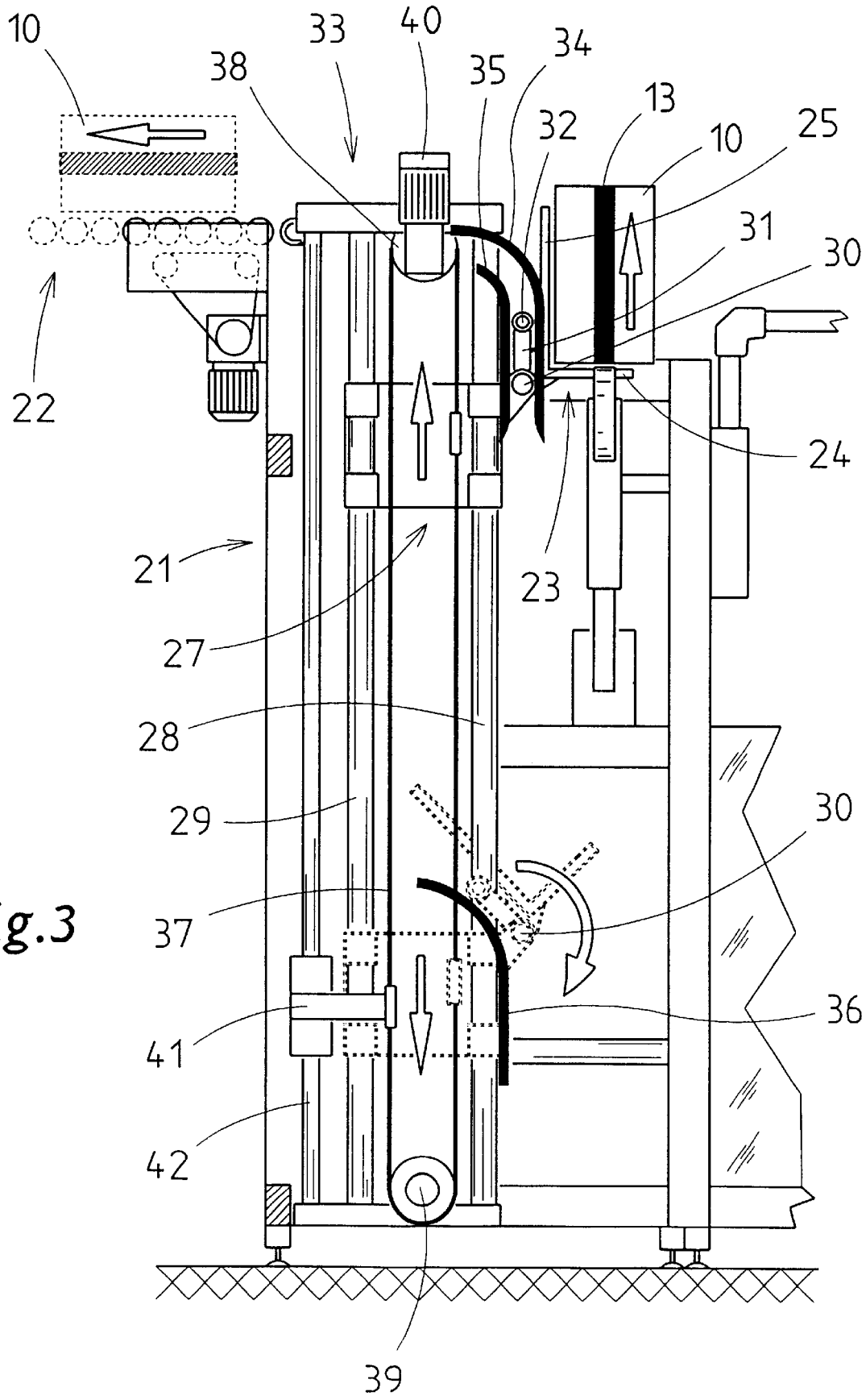
FIG. 3 shows a side view of the carton packer in another plane III—III of FIG. 1.

After tipping through 90° in the transfer station 33, the receptacle 23 is moved downwards in the tipped position for taking over the next carton 10. During the return into the receiving position for a carton (FIG. 2), a tipping movement is again performed, so that the receptacle 23 assumes the starting position.

The receptacle 23 is connected to a carrying body 27, which is moved exclusively up and down. The carrying body 27 is mounted on vertical guides, to be specific with sliding guides on two sliding bars 28, 29. Attached laterally to the carrying body 27 is the receptacle 23, to be specific with a transversely directed tipping bearing 30. The receptacle 23 can therefore move up and down with the carrying body 27, a tipping movement being carried out respectively in the upper end position and lower end position.

The tipping movements of the receptacle 23 are mechanically controlled. An actuating member of the receptacle 23 or of the tipping bearing 30 runs against stops through the conveying movement, so that the tipping operation is carried out as a result of the relative movement. For this purpose, an actuating lever 31 is attached to the receptacle 23. This lever is in a fixed relative position with respect to the receptacle 23. Arranged at the free end of the actuating lever 31 is a guide roller 32. This runs against a stop for initiating the tipping movement.

The stops are guideways on which the guide roller 32 runs. In the upper region, to be specific in the region of the transfer station 33, two spaced-apart, parallel-running guideways 34, 35 are arranged fixed in place. During the upward movement of the receptacle 23, the guide roller 32 runs into the region between the two vertical guideways 34, 35. Arcuate shaping at the upper end, to be specific a transitional arc into a horizontal plane, has the effect of correspondingly deflecting the guide roller 32. This deflecting movement has the effect that the tipping movement of the receptacle 23 is brought about by the actuating lever 31.

Lying opposite, that is in the lower region, there is provided a single guideway 36, with an upper arcuate running-on region.

During the downward movement of the receptacle 23, the guide roller 32 runs onto the arcuate region of the guideway 36 and, by the further movement into the region of a lower, vertical leg, is correspondingly deflected. As a result, the receptacle 23 returns into the starting position as a result of a corresponding tipping movement.

The upward and downward movements of the receptacle 23 are brought about by a vertical endless conveyor driven back and forth, to be specific by a toothed belt 37. This runs over upper and lower deflection rollers 38, 39. The upper deflection roller 38 can be driven by a motor 40 alternately in one direction and in the other direction. To compensate for the loads, a counterweight 41 is connected to the endless conveyor or toothed belt 37 and is guided by a (further) guide bar 42. The carrying body 27 is securely connected to one strand and the counterweight 41 to the other strand of the toothed belt 37.

The cartons 10 are monitored with regard to correct formation. This monitoring may relate to the packed contents, but applies in particular to the correct application of the carton closure in the region of the closing unit 26, in other words the correct application or presence of the adhesive strip 13. Possibly defective cartons, that is defective cartons 43, are not transferred to the removal conveyor 22, but are passed on for some other use. In the present case, the defective cartons 43 are moved downwards again into the region of a removal station 44 set up about halfway up, in the region of which the defective cartons 43 are removed from the apparatus. The removal station 44 comprises a downward-sloping chute 45 with an end stop 46. The defective carton is deposited on the chute 45 by the receptacle 23 during the downward movement and is taken by a sliding movement into a free removal position at the end stop 46.

Figure 4:
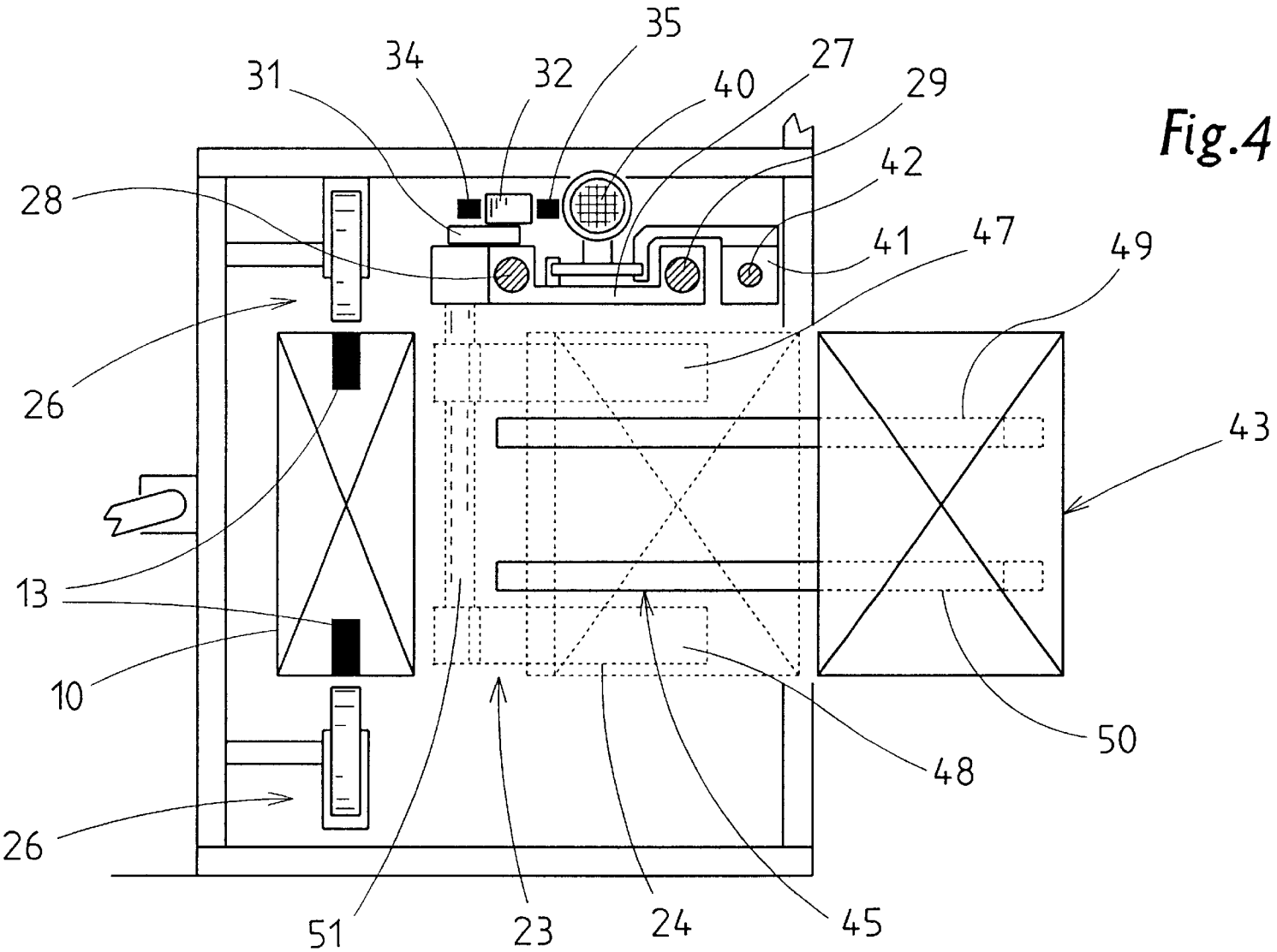
FIG. 4 shows a plan view and a horizontal section in the sectional plane VI—VI.

This transfer operation for defective cartons 43 is brought about by a corresponding shaping of the members involved, that is the receptacle 23 on the one hand and the chute 45 on the other hand. As can be seen in particular from FIG. 4, the receptacle 23 comprises two part-receptacles 47, 48 lying at a distance from each other and arranged in a fork-shaped manner. The chute 45, as the taking-over member for the defective cartons 43, is positioned between the part-receptacles 47, 48, so that the defective carton 43 is automatically deposited on the chute 45 during downward movement of the receptacle 23, the receptacle 23 or its part-receptacles 47, 48 being moved past the chute 45 in the downward direction. In the present example, the chute 45 also comprises two carrying elements 49, 50 lying at a distance from each other but between the part-receptacles 47, 48.

The angular part-receptacles 47, 48 are connected to a common tipping shaft 51. This is turned by the actuating lever 31 arranged at one end.

The handling of the cartons 10 on the one hand and the defective cartons 43 on the other hand takes place automatically in the region of the transfer station 33. Arranged in the region of the transfer station 33, that is at the (upper) end of the conveying section for the cartons 10, is an intermediate conveyor 52. This bridges the conveying path of the cartons 10 from the (tipped) receptacle 23 to the removal conveyor 22, which is arranged alongside the closing conveyor 21. The intermediate conveyor 52 is a conveyor belt, which is positioned in a horizontal plane approximately at the height of the removal conveyor 22. The intermediate conveyor 52 can be driven in the (horizontal) conveying position for conveying away a deposited carton 10 to the removal conveyor 22.

When a defective carton 43 reaches the transfer station 33, the intermediate conveyor 52 is moved out of the conveying position, to be precise by tipping away into a vertical position. For this purpose, the intermediate conveyor can be tipped about a deflection roll 53, remote from the receptacle 23 and facing the removal conveyor 22. The tipped-away position for the handling of a defective carton 43 is shown by dashed lines in FIG. 2.

As can be seen from FIG. 1, the intermediate conveyor 52 comprises two individual belts 54, 55. These are positioned between the part-receptacles 47, 48, so that the transfer of the cartons 10 to the intermediate conveyor 52 takes place automatically by the relative movement. If a defective pack 43 is detected and the intermediate conveyor 52 is moved out from the conveying position, no change occurs with regard to the movement of the receptacle 23. Rather, after completion of the tipping movement in the transfer station 33, it is moved downwards again, the defective carton 43 remaining on the receptacle 23 and being conveyed downwards with it as far as the removal station 44. Here, the transfer already described of the defective carton 43 to the chute 45 takes place.

LIST OF DESIGNATIONS

10 Carton
11 Folding flaps, outer

12 Folding flaps, inner
13 Adhesive strips
14 Magazine
15 Filling station
16 Group
17 Individual pack
18 Feed conveyor
19 Stacking table
20 Pusher
21 Closing conveyor
22 Removal conveyor
23 Receptacle
24 Carrying leg
25 Carrying leg
26 Closing unit
27 Carrying body
28 Guide bar
29 Guide bar
30 Tipping bearing
31 Actuating lever
32 Guide roller
33 Transfer station
34 Guideway
35 Guideway
36 Guideway
37 Toothed belt
38 Deflection roller
39 Deflection roller
40 Motor
41 Counterweight
42 Guide bar
43 Defective carton
44 Removal station
45 Chute
46 End stop
47 Part-receptacle
48 Part-receptacle
49 Carrying element
50 Carrying element
51 Tipping shaft
52 Intermediate conveyor
53 Deflection roll
54 Individual belt
55 Individual belt

We claim:

1. Apparatus for closing cartons (10) and detecting defective cartons 43, comprising:

a) a vertical carton conveyor (21), wherein cartons (10), filled in the region of a filling station (15) and fully folded, are fed to the vertical carton conveyor and conveyed by the latter to a closing unit (26) for fixing folding flaps (11) of the cartons (10), b) the cartons (10) transferred in the region of a transfer station (33) at an end of the carton conveyor (21) to a removal conveyor (22), c) testing members testing for defective cartons (43), such defective cartons (43) being moved through the transfer station (33) and past the removal conveyor (22) in the direction of the filling station (15), and d) a removal station (44) for taking the defective cartons (43) from the carton conveyor (21).

2. Apparatus according to claim 1, characterized in that the carton conveyor (21) is a vertical endless conveyor, in particular a toothed belt (37), to which there is attached at least one receptacle (23) for at least one carton (10) each, the receptacle (23) being able to be moved back and forth, between a lower end position and an upper end position, by the endless conveyor—toothed belt (37)—by a corresponding conveying direction.

3. Apparatus according to claim 2, characterized in that the receptacle (23) for the cartons (10) is of an angular form in cross section, with in each case a horizontal carrying leg (24) and a vertical carrying leg (25), the respectively upright carrying leg (24, 25) facing the endless conveyor or the toothed belt (37).

4. Apparatus according to claim 2, characterized in that the receptacle (23) is mounted on the carton conveyor (21) in such a way that it can tip through 90° in each case, and in that tipping movements of the receptacle (23) can be carried out for receiving or delivering a carton (10).

5. Apparatus according to claim 4, characterized in that tipping movements of the receptacle (23) are brought about by a tipping mechanism, in particular by an actuating member—actuating lever (31)—running onto a stop as a result of upward or downward movement of the receptacle (23).

6. Apparatus according to claim 2, characterized in that the cartons (10) can be deposited by the receptacle (23) onto other carrying members as a result of relative movement.

7. Apparatus according to claim 6, characterized in that, for depositing a carton (10) on a taking-over member, the receptacle (23) can be moved past the latter, in particular by a fork-shaped design of the receptacle (23) with preferably two part-receptacles (47, 48) which are arranged at a distance from each other and can be moved past correspondingly designed depositing members.

8. Apparatus according to claim 2, characterized in that, for transferring defective cartons (43) to the removal station (44), the intermediate conveyor (52) can be moved out of the path of movement of the receptacle (23) or of the carton (10) in the region of the transfer station (33), in particular by a downwardly directed tipping movement into an upright position, in such a way that the receptacle (23) with the defective carton (43) can be moved past the intermediate conveyor (52).

9. Apparatus according to claim 1, characterized in that, once they have been closed, the cartons (10) can be deposited by the closing conveyor (21) on an intermediate member, in particular on a horizontal intermediate conveyor (52) designed as a belt conveyor, which transports the cartons (10) to the removal conveyor (22).

* * * * *